US006244363B1

(12) United States Patent
McLeod

(10) Patent No.: US 6,244,363 B1
(45) Date of Patent: Jun. 12, 2001

(54) RETRIEVAL HEAD FOR A DRILL BIT COMPOSED OF A PLURALITY OF BIT SEGMENTS

(75) Inventor: Gavin T. McLeod, Ardross (AU)

(73) Assignee: DHT Technologies, LTD, Myaree (AU)

( * ) Notice: Subject to any disclaimer, the term of this patent is extended or adjusted under 35 U.S.C. 154(b) by 0 days.

(21) Appl. No.: 09/424,953

(22) PCT Filed: Jun. 4, 1998

(86) PCT No.: PCT/AU98/00421

§ 371 Date: Dec. 6, 1999

§ 102(e) Date: Dec. 6, 1999

(87) PCT Pub. No.: WO98/55730

PCT Pub. Date: Dec. 10, 1998

(30) Foreign Application Priority Data

Jun. 6, 1997 (AU) ..... PO 7247

(51) Int. Cl.[7] ..... E21B 31/06; E21B 31/12; E21B 10/64; E21B 10/66

(52) U.S. Cl. ..... 175/258; 166/66.5; 166/99; 294/86.25

(58) Field of Search ..... 166/66.5, 99, 98, 166/301; 175/257, 258, 290, 325.1, 284; 294/86.17, 86.2, 86.24, 86.25, 86.1

(56) References Cited

U.S. PATENT DOCUMENTS

| | | | | |
|---|---|---|---|---|
| 4,059,155 | * | 11/1977 | Greer | 166/301 |
| 4,760,888 | | 8/1988 | Saito | 175/259 |
| 5,662,182 | | 9/1997 | McLeod et al. | 175/258 |
| 5,785,134 | * | 7/1998 | McLeod et al. | 175/258 |
| 5,954,146 | * | 9/1999 | McLeod et al. | 175/257 |

FOREIGN PATENT DOCUMENTS

| | | | |
|---|---|---|---|
| 88401/82 | | 3/1983 | (AU) . |
| 0 208 532 A2 | | 7/1986 | (EP) . |
| WO 94/29567 A1 | * | 12/1994 | (WO) . |

* cited by examiner

*Primary Examiner*—David Bagnell
*Assistant Examiner*—Jennifer M. Hawkins

(57) ABSTRACT

A retrieval head (14) coupled to a downhole tool that is used for retrieving a drill bit composed of individual drill bit segments (14). The down hole tool is adapted to travel through a drill sting and a drive sub (12) attached to the drill string. The tool also releases segments (14) which are clamped between the drive sub (12) and a bit locking sleeve (16). The retrieval head (10) includes a body (30) having a first length (32) and a contiguous second length (34). The first length (32) is of constant diameter. The second length (34) has a portion (42) of reduced diameter relative to that of the first length (32). The diameter of the first length (32) is dimensioned so that the bit segments (14) can initially collapse radially inwardly wholly onto an outer circumferential surface (38) of the length (32). The reduced diameter portion (42) is dimensioned so that when the bit segments (14) are disposed thereon, the bit segments (14) can pass through the drive sub (12) and bit locking sleeve (16). In use, when the bit segments (14) clamped to the drive sub (12) are collapsed onto the first length (32) and a down hole tool to which the retrieval head (10) is coupled is pulled upwardly, the bit segments (14) slide relative to and along the head (10) from the first length (32) by abutment of the bit segments (14) with the drive sub (12) and/or bit locking sleeve (16); to the reduced diameter portion (42) where the bit segments (14) together with the retrieval head (10) can pass through the locking sleeve (16) and the drill string to be retrieved.

13 Claims, 3 Drawing Sheets

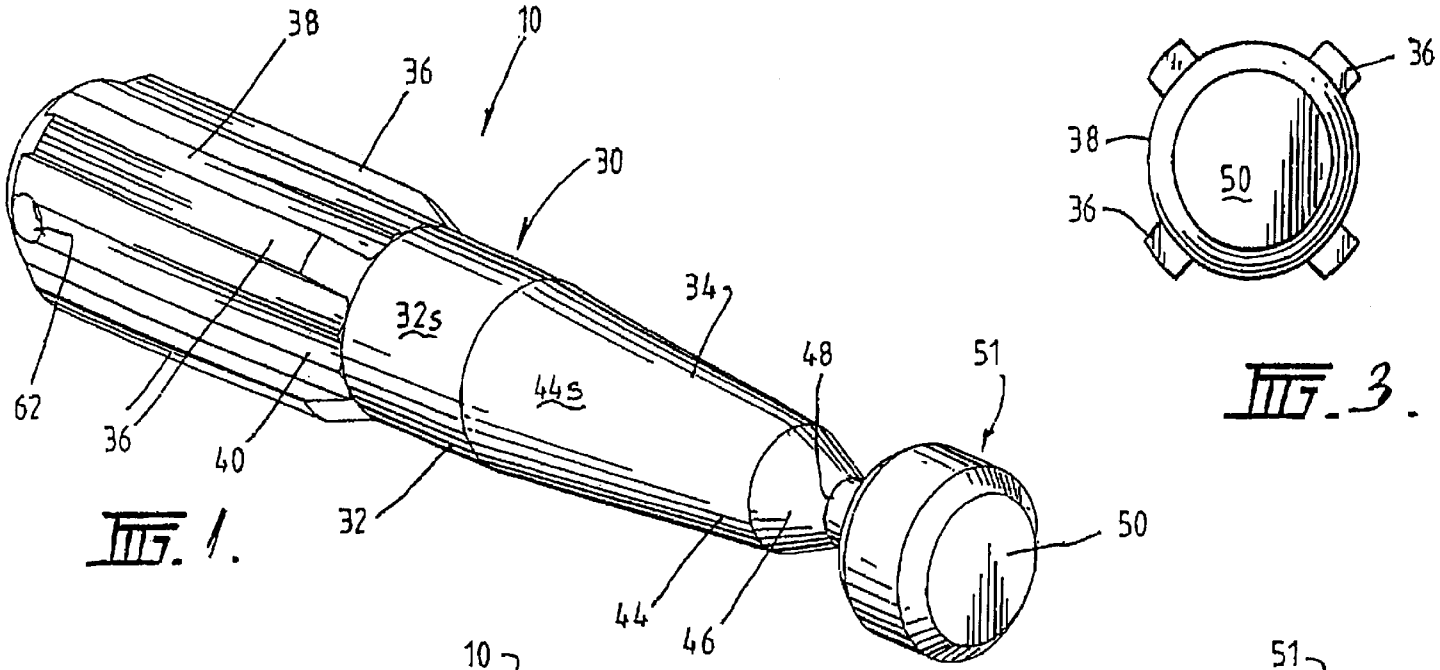
FIG. 1.
FIG. 3.
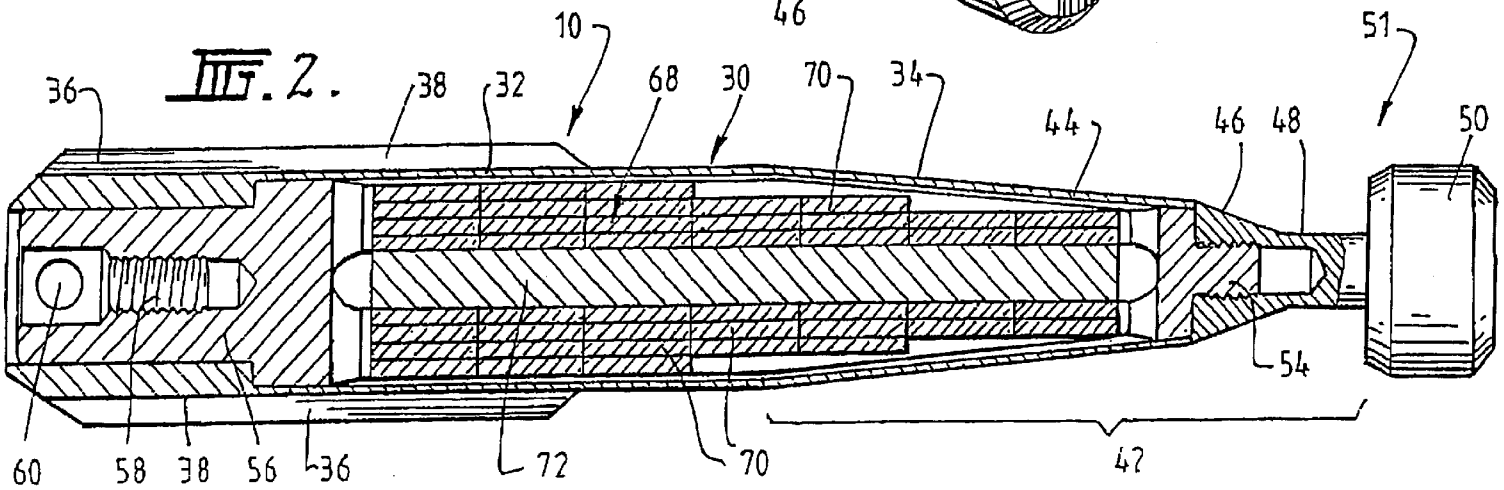
FIG. 2.

RETRIEVAL HEAD FOR A DRILL BIT COMPOSED OF A PLURALITY OF BIT SEGMENTS

FIELD OF THE INVENTION

This invention relates to a retrieval head for use in conjunction with a down hole tool for in situ retrieval of a drill bit composed of a plurality of bit segments.

BACKGROUND TO THE INVENTION

A system for in situ replacement of a drill bit for a ground drill is described in Applicant's International Application No PCT/AU94/00322 (WO 94/29567), the contents of which is incorporated herein by way of reference. The system in WO 94/129567 comprises a drive sub which is adapted for connection to a lower end of a core barrel attached to a drill pipe; a core drill bit composed of a plurality of separate bit segments; a bit locking sleeve for selectively locking the bit segments onto seats provided about an inner surface of the drive sub and subsequently releasing the bit segments from those seats; and, a down hole tool for operating the bit locking sleeve and installing and retrieving the drill bit segments.

A slidable cradle extends from a lower end of the down hole tool for carrying the bit segments to and from the drive sub. When installing the bit segments, the cradle is extended from a lower end of the tool against the bias of a spring. Bit segments are then held by elastic bands about the cradle with one end abutting a stop provided at a distant end of the cradle and an opposite end of each segment bearing against a head of the down hole tool. When the down hole tool is lowered into the ground drill and reaches a predetermined position within the drive sub, the cradle is retracted into the main body of the tool by the spring. This causes an upper end of the bit segments to slide along the head of the tool so as to extend laterally of the periphery of the tool. The bit locking sleeve is simultaneously pushed by the tool so as to catch the ends of, and move inside, the bit segments thereby expanding the bit segments to the inner diameter of the drive sub and locking the bit segments into a cutting position.

When it is necessary to change the core bit and thus retrieve the bit segments, the tool is again lowered into the drill pipe and drive sub with the cradle locked into the extended position. At a predetermined position, the down hole tool engages the bit locking sleeve at which time the cradle extends from the lower end of the drive sub. The down hole tool is then pulled upwards a short distance. This pulls the bit locking sleeve upwards thereby releasing the bit segments from the seats on the drive sub. The bit segments collapse onto the cradle by action of the elastic band. Upon further upward pulling of the down hole tool, the tool releases itself from the bit locking sleeve and can thus be pulled to the surface with the bit segments.

Field trials of the above system have proved very successful. However, it is believed that one possible source of failure of the system is that when the bit segments are released so as to collapse onto the cradle there is a remote but nevertheless existent possibility that they can jam in the drive sub and in particular with the bit locking sleeve. This can arise because when the bit segments are released and commence to collapse onto the cradle, they pivot or tilt radially inwardly from the lower end of the bit segments with increasing angle until the bit locking sleeve is pulled completely away from the bit segment. If the tool is withdrawn very quickly so that the uppermost end of the bit segments have not had sufficient time to fully collapse onto the cradle, perhaps due to the viscous nature of the fluid within which the drill is operating, the upper end of the bit segments can jam with the lower end of the bit locking sleeve.

SUMMARY OF THE INVENTION

It is an object of the present invention to provide a retrieval head adapted for use with a down hole tool which will substantially eliminate any possibility of jamming of the bit fingers during the retrieval process.

According to the present invention there is provided a retrieval head for coupling to a down hole tool for retrieving a drill bit composed of a plurality of bit segments, the down hole tool adapted to travel through a drill string and a drive sub attached to the drill string, the tool further adapted to release bit segments clamped between the drive sub and a bit locking sleeve held within the drive sub so that the bit segments can collapse onto the retrieval head, the retrieval head including:

a body having a first length and a contiguous second length, the first length being of a first constant diameter and the second length having a portion of reduced diameter relative to the first diameter, the first diameter being dimensioned so that the bit segments can initially collapse radially inwardly wholly onto an outer circumferential surface of the first length; and, the reduced diameter portion being dimensioned so that when the bit segments are arranged about the reduced diameter portion, the bit segments can pass through the drive sub bit locking sleeve and drill string; whereby, in use, when bit segments clamped to the drive sub are collapsed onto the first length and the down hole tool, to which slide retrieval head is coupled, is pulled upwardly, the bit segments slide relative to and along the retrieval head from the first length by abutment of the bit segments with the drive sub and/or bit locking sleeve to the reduced diameter portion where the bit segments together with the retrieval head can pass through the bit locking sleeve and drill string to be retrieved by said down hole tool.

Preferably the reduced diameter portion includes a first part of progressively decreasing diameter contiguous with the fist length.

Preferably the first part comprises a first part frustum contiguous with the first length.

Preferably the reduced diameter portion includes a second part contiguous with the first part.

Preferably the second part includes a second frustum contiguous with the first frustum and having a diameter which reduces at a greater rate than that of the first frustum.

Preferably said retrieval head further includes a stop coupled to an end of said second length distant said first length against which said bit segments can abut to prevent said segments from failing off said retrieval head.

Preferably said retrieval head further includes centering means provided on the outer circumferential surface of the first length for substantially centering the retrieval head within the drill string, drive sub and bit locking sleeve.

Preferably said centering means comprises a plurality of raised ridges running longitudinally of said first length and spaced about the circumference of said first length.

Preferably said ridges are spaced by a distance to receive a single bit segment.

Preferably opposite ends of said ridges progressively taper in height to the level of said outer circumferential surface of said first length.

Preferably said retrieval head filter includes magnetic means disposed along a portion of said first and second lengths for attracting bit segments upon release from said drive sub and holding said bit segments to said retrieval head.

Preferably said retrieval head comprises a central core extending along said first and second lengths for housing said magnetic means, and sleeve means of non-magnetic material for covering said core.

Preferably said sleeve means comprises a first sleeve part for covering said first length and a separate second sleeve part for covering said second length.

Preferably said retrieval head is further provided with means for releasably coupling said retrieval head to a down hole tool.

BRIEF DESCRIPTION OF THE DRAWINGS

An embodiment of the present invention will now be described by way of example only, with reference to the accompanying drawings in which:

FIG. 1 is an isometric view of an embodiment of the retrieval head in accordance with the present invention;

FIG. 2 is a longitudinal section view of the retrieval head shown in FIG. 1;

FIG. 3 is an end view of the retrieval head shown in FIGS. 1 and 2;

DETAILED DESCRIPTION OF THE PREFERRED EMBODIMENT

Figure 5:
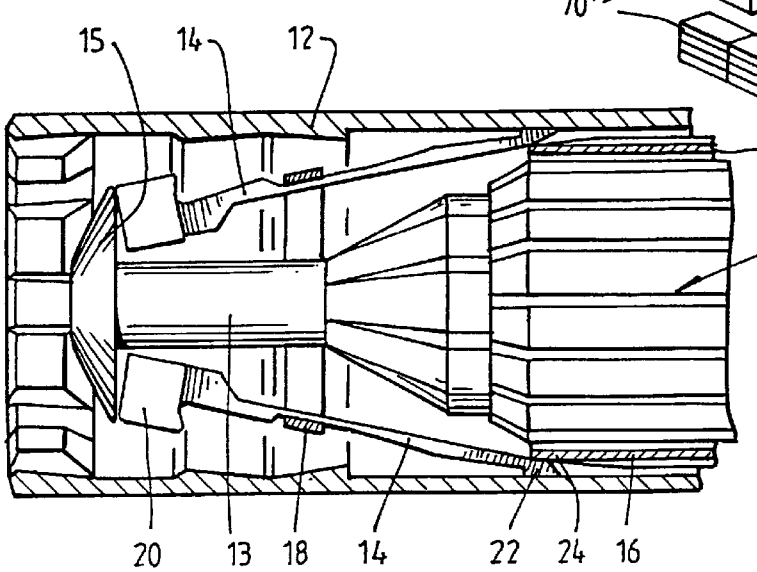
FIG. 5. PRIOR ART
FIG. 5 is a representation of a prior art retrieval head.
Figure 6A:
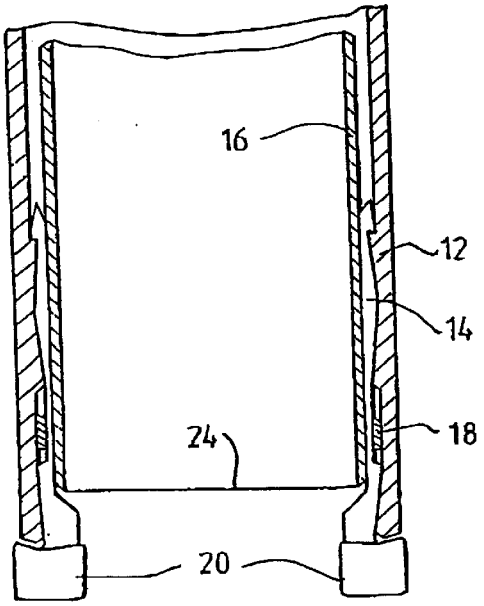
FIGS. 6A–6C are schematic representations of the retrieval head when in use retrieving bit segments from a drill string.

The retrieval head 10 shown in the accompanying drawings is typically used in a system for in situ replacement of drill bit segments of a core drill of the type described in the afore-referenced WO 94/29567. In that system, a part of which is depicted in FIG. 5, a running tool 11 is used to transport bit segments to and from a drive sub 12. The tool 11 includes a cradle 13 onto which the bit segments 14 are loaded when transported to and from the drive sub. The cradle 13 in essence comprises a bar or shank of constant diameter with an enlarged head 15 at its lowermost end. The same cradle 13 is used for both retrieval and installation of the bit segments 14. The bit segments 14 are held in place by a bit locking sleeve 16 which is slid up and down the drive sub by the down hole tool. FIG. 6A depicts the bottom end of a core drill of the type described in the above-referenced document immediately prior to retrieval of the bit segments. The bit segments 14 are clamped by the bit locking sleeve 16 to the drive sub 12. Elastic band 18 extends about the bit segments 14 and is retained within a cavity or recess formed between the bit segments 14 and an inner circumferential surface of the drive sub 12. The down hole tool 11 is lowered through a drill string (not shown) into the drive sub 12 to a point where it engages the bit locking sleeve 16. A down hole tool 11 is then pulled upwardly a short distance. This pulls the bit locking sleeve 16 upwardly thereby releasing the bit segments 14 which are free to collapse onto the cradle 13 of the down hole tool 11 by virtue of the compression of elastic band 18.

It will be recognised that as the bit locking sleeve 16 is pulled upwardly the segments 14 pivot radially inwardly. The pivoting motion effectively ceases when the lowermost end 20 of the segments 14 abut the cradle 13 on the down hole tool 11. The cradle 13 on the down hole tool is of relatively small diameter and therefore the angle of pivoting is relatively large.

If the down hole tool is retracted too quickly, upper ends 22 of the bit fingers may not have sufficient time to locate against the body of the tool and/or cradle. Therefore the upper ends 22 may get caught on lower end 24 of the bit locking sleeve 16 or indeed on other components (such as a landing ring) within the drill string. FIG. 5 enclosed depicts how this may happen in the prior art.

The present retrieval head 10 was developed to alleviate the possibility of the bit segments jamming when being retrieved. The retrieval head 10 is adapted for connection to a down hole tool of the type described in the above-mentioned reference in place of the described cradle.

Referring to FIGS. 1 to 4, it can be seen that the retrieval head 10 comprises a body 30 having a first length 32 and contiguous second length 34. The first length 32 is of substantially constant diameter. Four raised ridges 36 run longitudinally along an upper portion of the first length 32. The ridges 36 are evenly spaced about outer circumferential surface 38 of the first length 32 and taper at their opposite ends down to the surface 38. Because the ridges 36 are formed by milling, a pair of flats 40 extend parallel to and on opposite sides of each ridge 36. However, the flats 40 are of no particular significance and simply arise due to the manufacturing process.

Figure 4:
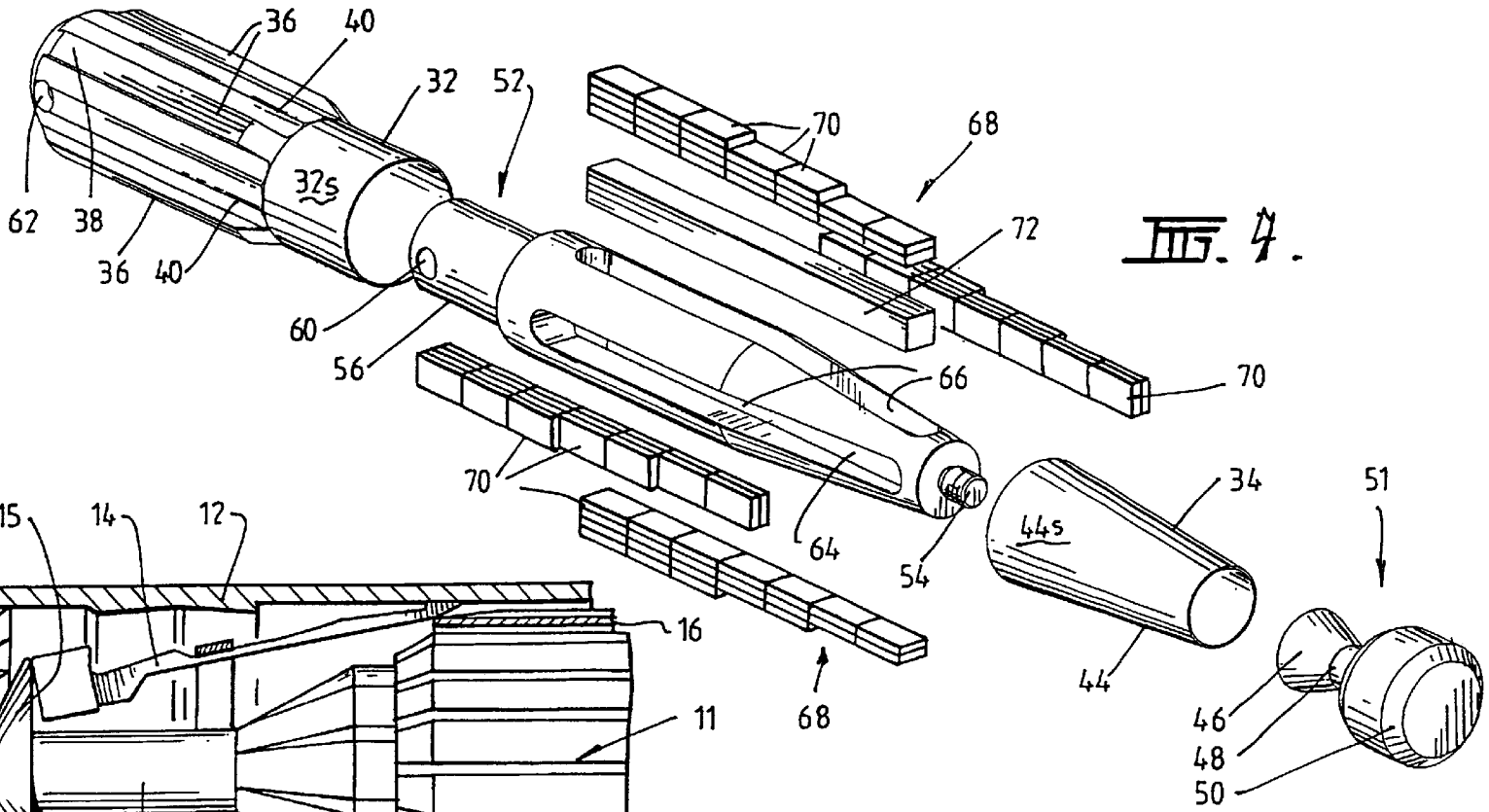
FIG. 4 is an exploded view of the retrieval head shown in FIGS. 1 and 2.

The second length 34 has a portion 42 of reduced diameter relative to that of the first length 32. Indeed, the portion 42 is composed of several separate sections of lengths of differing diameter. Specifically, there is a first frustum 44 which is contiguous with the first length 32 and is of progressively reducing diameter. Contiguous with the first frustum 44 is a second frustum 46 which has a diameter which decreases at a greater rate than that of the first frustum 44. Contiguous with the second frustum 46 is a part 48 of constant diameter. The part 48 terminates with a bulbous stop 50 of a diameter in the order of that of the first part 32. As shown in FIGS. 2 and 4, the second frustum 46, constant diameter part 48 and stop 50 are formed as a single integral unit 51 separate from the first frustum 34 although together they comprise the second length 34.

As shown in FIGS. 2 and 4, the retrieval head 10 includes a central core 52. The core 52 is covered by a two part sleeve comprising Fusto-conical sleeve $\mathbf{44}_s$ which sits on an upper frusto-conical shaped length of the central core 52 which in part forms the second length 34, and a tubular sleeve $\mathbf{32}_s$ which covers a first length 32. A lower end of the core 52 is provided with a threaded stud 54 which threadingly engages the unit 51. This effectively locks the sleeve $\mathbf{44}_s$ onto the central core 52. A reduced diameter portion 56 at a upper end of the core 52 is also provided with an internal threaded cavity 58 for coupling to the down hole tool used to transport the retrieval head 10 to the drive sub 12 for installing and reprieving bit segments 14. A transverse hole 60 is also provided in the reduced diameter portion 56 for registration with a similar hole 62 formed in the sleeve $\mathbf{32}_s$. A threaded stud or other mechanical fastener (not shown) passes through holes 62 and 60 to lock the shell $\mathbf{32}_s$ onto the core 52.

The core 52 is provided with an internal cavity 64 and four longitudinally extending slots 66 which provide access to the cavity 64. Magnetic means 68 in the form of magnets 70 and rectangular bar 72 are housed within the cavity 64 and slots 66. Specifically, a series of rectangular rare magnets are initially built up on to opposite sides of the rectangular bar 72. Because the second part 34 of the head 10 is of reducing diameter, the number of magnets 70 stacked upon each other reduces along the length of the bar 72. Once the magnets 70 have been built up upon opposite sides of the bar 72 that sub-assembly is installed in the core 52 with the bar 72 located in the recess 64 and the magnets 70 in the opposing slots 66. To complete the magnetic means 68, magnets 70 are now built up upon the opposing free faces of the bar 72 through the open available slots 66.

The core 52, as well as sleeves $\mathbf{32}_s$, $\mathbf{44}_s$, and are made from non-magnetic material such as aluminium.

Figure 6B:
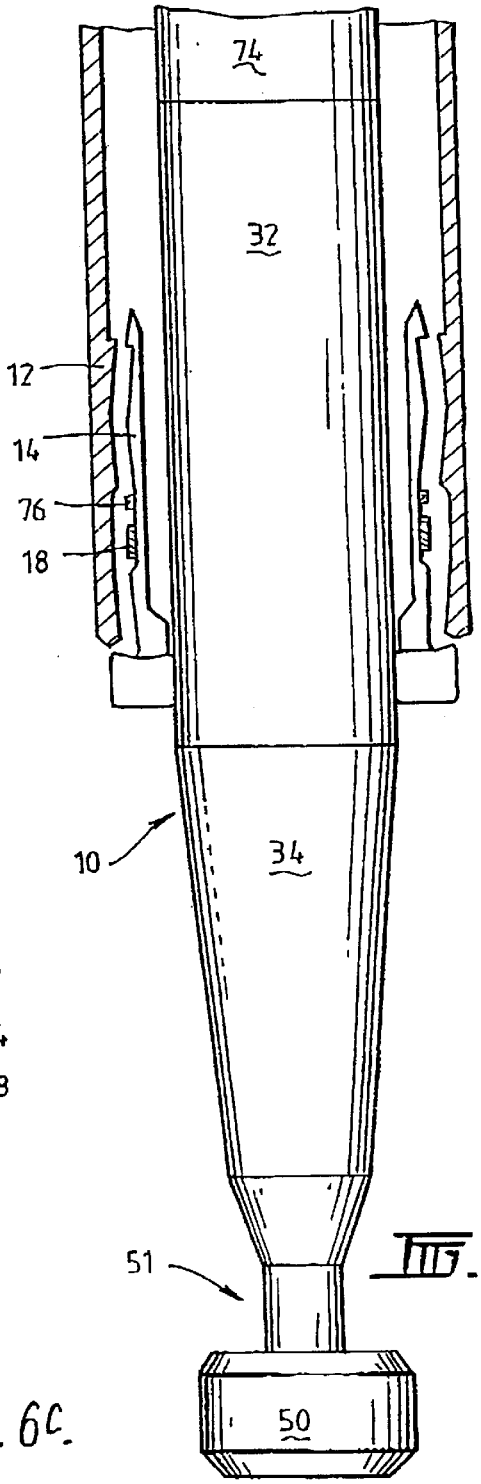
Figure 6C:
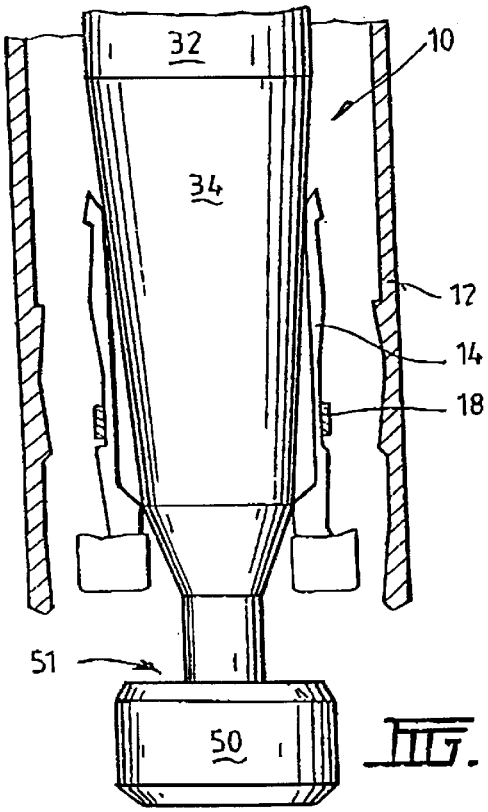

The operation of the retrieval head 10 will now be described with particular references to FIGS. 6A–6C. FIG. 6A shows the configuration of the drive sub 12, bit segments 14, and bit locking sleeve 16 prior to retrieval of the bit segments 14. The retrieval head 10 is fastened to the lowermost end of a down hole tool 74 and lowered through the drill string to the drive sub 12 to a point where substantially the whole length of the retrieval head 10 extends beyond the lowermost end of the drive sub 12. The tool 74 is then drawn upwardly a short distance as shown in FIG. 6B. In doing so, latch dogs (not shown) on the tool 74 engage the bit locking sleeve 16 and pull the locking sleeve upwardly so as to release the bit segments 14. This upward movement also results in the first length 32 of the head 10 being drawn within the drive sub 12 (as shown in FIG. 6B). With the bit locking sleeve 16 pulled out of the way, the action of the elastic band 18 assists in collapsing the bit segments 14 onto the first length 32. To further assist in releasing the segments 14 from the drive sub 12, elastomeric pads 76 can be adhered to a face of the bit segments 14 which would normally contact the inner surface of the drive sub 12. Further, the magnets 70 held within the core 52 of the tool 10 also attract the segments 14 to the head 10 and indeed are of sufficient strength so as to hold the segments 14 onto the head 10 in the absence of the elastic band 18. This is advantageous in the occurrence of a failure in the band 18, for example due to breakage or melting.

As seen in FIG. 6B when he segments 14 collapse onto the first length 32, their lowermost end or crown 20 may still abut the lowermost end of the drive sub 12. As the tool 74 is pulled further upwardly, the abutment of the segments 14 on the drive sub 12 results in the head 10 sliding inside the segments 14. As this sliding motion continues, the segments 14 are moved radially inwardly due to the reducing diameter of the second length 34 and in particular due to the tapering nature of the frustums 44 and 46. Eventually, the segments 14 are located about a portion on the second length 34 at which they can pass wholly through the drive sub 12 as shown in FIG. 6C. In order to be wholly retrieved, the segments 14 and head 10 must also pass through the bit locking sleeve 16 which is disposed higher up in the drive sub 12. If any part of the segments 14 abut the bit locking sleeve 16 on the upward movement of the tool 74, then the head 10 will again simply slide inside the segments 14 to a position where the segments 14 can then pass through the bit locking sleeve 16. A similar action will occur if the segments 14 contact any other internal component in the ground drill when the tool 74 is being withdrawn. For example if the segments 14 come into contact with a landing ring typically used in core drilling systems.

The stop 50 provides an abutment surface to prevent the segments 14 from falling off the end of the head 10. The constant diameter part 48 is dimensioned so that if the segments 14 slide relative to the head 10 to the position where the segments 14 about the stop 50, the radially outermost portions of the crowns 20 do not extend beyond the radius of the stop 50.

The ridges 36 assist in maintaining the head 10 in a centralised position through the drive sub 12 and associated drill string (not shown). Thus, while the magnets 70 will cause the head 10 to tend to be attracted to one side of the drill string and thus tend to skew the head and perhaps the tool 74, the ridges 36 substantially limit the skewing of the head 10. The tapered opposite ends of each ridge 36 also ensure that the ridges 36 do not become locked on any internal component of the drill. Further, the ridges 36 are spaced by a distance so that a single bit 14 can be disposed therebetween when initially released from the drive sub 12.

From the above description of the preferred embodiment, it is clear that the retrieval head 10 enjoys numerous advantages and benefits over the prior art system for retrieving bit segments 14. Significantly, because of the relative diameters of the first and second lengths 32 and 34, when the bit segments 14 are first released, they need travel only a short distance to contact the surface of the first length 32. As such, the degree of pivoting or tilting of the segments 14 is minimised in comparison to that in the prior art. Indeed, due to the configuration of the segments 14, the angle of pivot is actually in an opposite sense to that in the prior art. This substantially avoids the possibility of the upper ends 22 of the bit segments 14 catching in the bit locking sleeve 16 or other components of the drill when being withdrawn. Also, the segments 14 are able to slide along the body of the head 10, to a position in which they can pass through any typical constriction within the ground drill. The magnets 70 assist in holding the segments 14 to the head 10 in the event that the bands 18 break or melt.

Now that an embodiment of the present invention has been described in detail, it will also be apparent to those should in the relevant arts that numerous modifications and variations may be made without departing from the basic inventive concepts. For example, the sleeve $\mathbf{44}_s$, and unit 51 are shown as separate components. However, they can be manufactured as an integral unit. Also, the magnetic means 68 is shown as being essentially built up from a rectangular bar and a plurality of small magnets however any suitable form of magnetic assembly, be it one piece or made from separate components, can be used. All such modifications and variations are deemed to be within the scope of the present invention the nature of which is to be determined from the foregoing description and the appended claims.

The claims defining the invention are as follows:

1. A retrieval head for coupling to a down hole tool for retrieving a drill bit composed of a plurality of bit segments, the down hole tool adapted to travel through a drill string and a drive sub attached to the drill string, the tool further adapted to release bit segments clamped between the drive sub and a bit locking sleeve held within the drive sub so that the bit segments can collapse onto the retrieval head, the retrieval head including:

a body having a first length and a contiguous second length, the first length being of a first constant diameter and the second length having a portion of reduced diameter relative to the first diameter; the first diameter being dimensioned so that the bit segments can initially collapse radially inwardly wholly onto an outer circumferential surface of the first length; and, the reduced diameter portion being dimensioned so that when the bit segments are arranged about the reduced diameter portion, the bit segments can pass through the drive sub, bit locking sleeve and drill string; whereby, in use, when bit segments clamped to the drive sub are collapsed onto the first length and the down hole tool, to which the retrieval head is coupled, is pulled upwardly, the bit segments slide relative to and along the retrieval head from the first length, by abutment of the bit segments with the drive sub and/or bit locking sleeve, to the reduced diameter portion where the bit segments together with the retrieval head can pass through the bit locking sleeve and drill string to be retrieved by said down hole tool.

2. A retrieval head according to claim 1 wherein the reduced diameter portion includes a fist part of progressively decreasing diameter contiguous with the first length.

3. A retrieval head according to claim 2 wherein the first part comprises a first frustum contiguous with the first length.

4. A retrieval head according to claim 3 wherein the reduced diameter portion includes a second part contiguous with the first part.

5. A retrieval head according to claim 4 wherein the second part includes a second frustum contiguous with the first frustum and having a diameter which reduces at a greater rate than that of the first frustum.

6. A retrieval head according to claim 1 further including a stop coupled to an end of said second length, distant said first length, against which said bit segments can abut to prevent said segments from falling off said retrieval head.

7. A retrieval head according to claim 1 further including centering means provided on the outer circumferential surface of the first length for substantially centering the retrieval head within the drill string, drive sub and bit locking sleeve.

8. A retrieval head according to claim 7 wherein said centering means comprises a plurality of raised ridges running longitudinally of said first length and spaced about the circumference of said first length.

9. A retrieval head according to claim 8 wherein said ridges are spaced by a distance to receive a single bit segment.

10. A retrieval head according to claim 9 wherein opposite ends of said ridges progressively taper in height to the level of said outer circumferential surface of said first length.

11. A retrieval head according to claim 1 further including magnetic means disposed along a portion of said first and second lengths for attracting bit segments upon release from said drive sub and holding said bit segments to said retrieval head.

12. A retrieval head according to claim 11 further including a central core extending along said first and second lengths for housing said magnetic means, and sleeve means of non-magnetic material for covering said core.

13. A retrieval head according to claim 12 wherein said sleeve means comprises a first sleeve part for covering said first length and a separate second sleeve part for covering said second length.

* * * * *